US007644673B2

(12) United States Patent
Schmitt

(10) Patent No.: US 7,644,673 B2
(45) Date of Patent: Jan. 12, 2010

(54) EMERGENCY ENCAPSULATED LIFT SYSTEM

(76) Inventor: Darrin John Schmitt, 2447 E. Hidden Way, Port Angeles, WA (US) 98362

( * ) Notice: Subject to any disclaimer, the term of this patent is extended or adjusted under 35 U.S.C. 154(b) by 85 days.

(21) Appl. No.: 11/379,989

(22) Filed: Apr. 24, 2006

(65) Prior Publication Data

US 2006/0249068 A1 Nov. 9, 2006

Related U.S. Application Data

(60) Provisional application No. 60/673,943, filed on Apr. 22, 2005.

(51) Int. Cl.
*B63B 43/10* (2006.01)

(52) U.S. Cl. ..... 114/68

(58) Field of Classification Search ..... 114/68, 114/69, 345, 360, 219, 218, 343, 364
See application file for complete search history.

(56) References Cited

U.S. PATENT DOCUMENTS

| | | | | | |
|---|---|---|---|---|---|
| 6,469 | A * | 5/1849 | Lincoln | 114/49 |
| 1,375,055 | A * | 4/1921 | Lodato | 114/68 |
| 4,458,618 | A | 7/1984 | Tuffier | |
| 4,817,555 | A | 4/1989 | Meinen | |
| 4,864,961 | A | 9/1989 | Slonski | |
| 4,996,936 | A | 3/1991 | Brundritt | |
| 5,357,888 | A * | 10/1994 | Insinna | 114/69 |
| 6,080,027 | A | 6/2000 | Rodemann | |
| 6,161,494 | A * | 12/2000 | Pontevolpe et al. | 114/219 |
| 6,598,550 | B1 | 7/2003 | Patel | |
| 6,802,274 | B2 * | 10/2004 | Mears et al. | 114/68 |

OTHER PUBLICATIONS

Application #11/379773 filed Apr. 21, 2006 entitled Emergency Encapsulated Lift System by Schmitt, Darrin John.*

* cited by examiner

*Primary Examiner*—Lars A Olson
*Assistant Examiner*—Daniel V Venne
(74) *Attorney, Agent, or Firm*—Black Lowe & Graham PLLC; Richard T. Black; Richard C. Vershave

(57) ABSTRACT

A buoyancy lift system having an inflatable bladder with a tether stowed inside a canister secured to a vessel. A sealing member is slidably received within canister and secures to the inflatable bladder. Pressurized gas forces the sealing member and bladder outwardly of the canister. A stop prevents the sealing member from escaping the canister such that the sealing member creates a seal between itself and the canister at an outboard end of the canister. Pressurized gas is forced through a channel in the sealing member into the bladder to increase the displacement of a vessel.

7 Claims, 11 Drawing Sheets

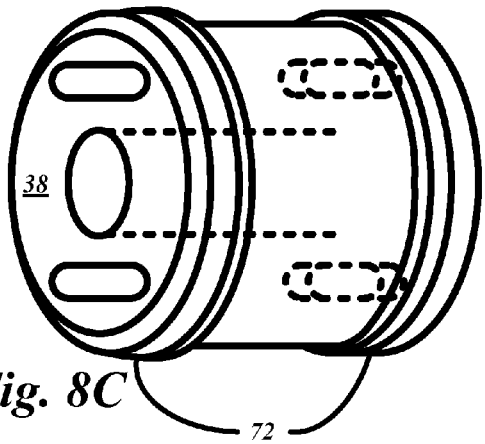
Fig. 8C
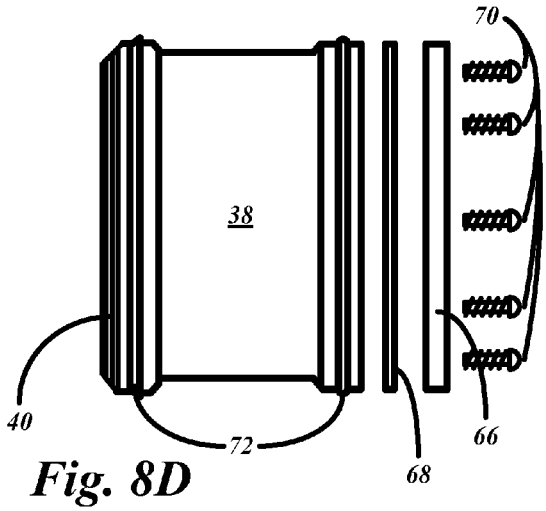
Fig. 8D
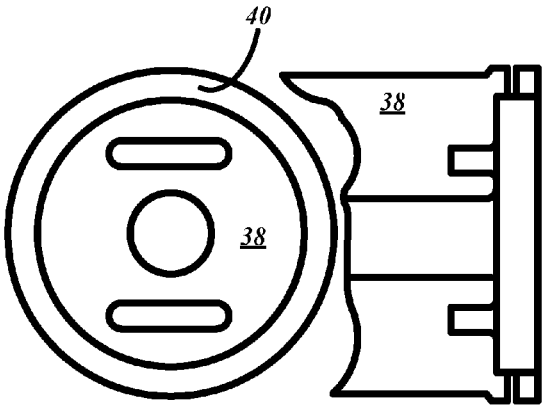
Fig. 8B
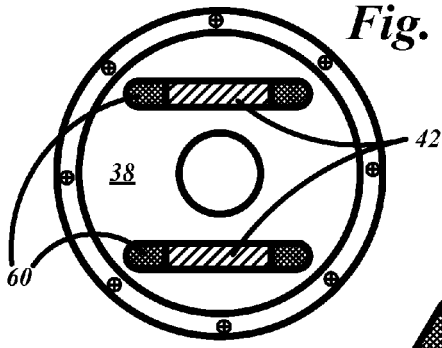
Fig. 8E
Fig. 8F
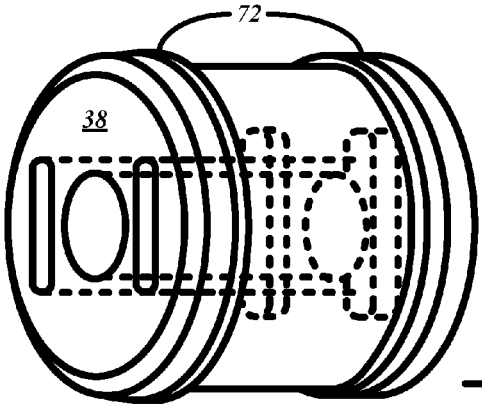
Fig. 8A
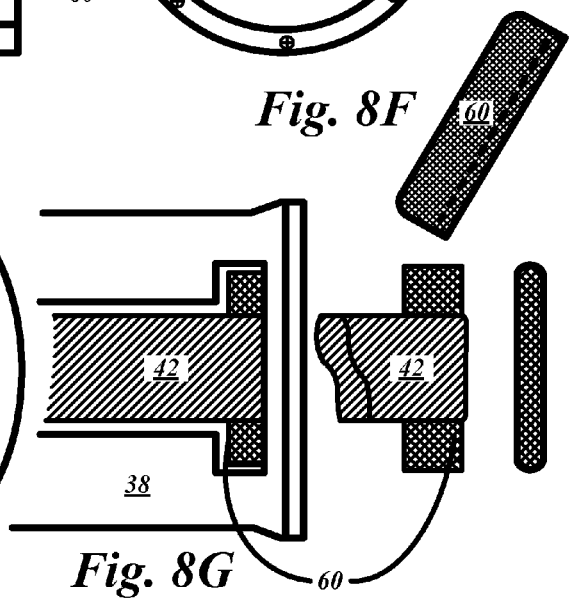
Fig. 8G

EMERGENCY ENCAPSULATED LIFT SYSTEM

FIELD OF THE INVENTION

This application claims the benefit of Provisional Application Ser. No. 60/673,943 filed Apr. 22, 2005, which is hereby incorporated by reference.

FIELD OF THE INVENTION

This invention relates generally to a life and property saving devices of the type which can be automatically or manually activated to expel a buoyancy compensation bladder from the interior of a vehicle through an outer wall of a vehicle or from a point of securement to a vehicle into the surrounding water to provide additional buoyancy in the event that the vehicle is in danger of sinking.

BACKGROUND OF THE INVENTION

Every year, life and property are lost on the water. Power and sail, recreational and commercial vessels and equipment alike are all in danger of sinking due to loss of buoyancy. In fact most vessels, vehicles or aircraft traveling over water have at one time or another needed buoyancy enhancement. The problem has been somewhat alleviated by the advent of new construction materials and designs. Many systems have been designed and installed to make ships, boats, aircraft, and other vessels and equipment safer at sea and to keep such craft afloat when they are in danger of sinking. Most commonly, marine vessels use pumps of one sort or another to pump water from inside the hull over the side. Such systems have been used successfully for generations, and have saved property and many lives. However, such systems are effective only so long as the capacity of the pumping system exceeds the rate at which water is coming into the vessel. If the amount of water entering a vehicle exceeds the capacity of the pumps or they fail to dispose the water outside of the vessel, the vessel is doomed to sink. Pumping systems and other systems designed to prevent sinking often have little to no buoyancy in themselves.

Previous devices designed to enhance buoyancy have not provided a viable solution for the industry for a number of reasons. Primarily, they are not designed to be conveniently maintained or tested to ensure constant working conditions. Many systems cannot both easily fit into the limits of space and provide the amount of buoyancy required to keep a vessel from sinking. Previous devices also adversely affect the desired efficiency or appearance of the vessels' design and thus their marketability. Most prior systems also are effective only for watercraft, or a specific type of watercraft.

Accordingly, it would be an advancement in the art to provide a system providing an effective amount of buoyancy and yet accommodating space constraints on a vessel. Such a system should also avoid degrading the aesthetics of the vessel. It would be a further advancement in the art to provide such a system that is usable in multiple types of watercraft and in vehicles and equipment other than watercraft.

SUMMARY OF THE INVENTION

The present invention is directed toward a compact, deployable, encapsulated, lift system providing supplemental buoyancy compensation for vessels to prevent capsizing or sinking. Vessels in which the invention may be used include, but are not limited to, all nautical vessels, vehicles traveling over ice and water, aircraft or aviation equipment, shipping containers, submersibles, and research vessels.

Preferred embodiments of the present invention provide buoyancy and stabilization to the marine or aircraft vessel or other desired equipment by displacing sufficient water to keep the vessel afloat at or near it's intended waterline or at an intended displacement level for other applications until either help can arrive, repairs can be performed, or until the vessel can be brought safely to port. Because some embodiments of the invention are deployed below the waterline 14 and some bladder designs are cylindrical, large displacements may be achieved. Embodiments maintaining the vessel at or near an intended waterline 14 enable continued operation of the vessel, giving personnel needed time and peace of mind to react to the emergency. Preferred embodiments of the present invention are applicable to any vessel design regardless of type or size.

The encapsulated lift device includes a canister adapted to secure to a vessel, the canister having a first end and a second end, the first end and second end each define an opening. A plug secures within the first opening by means of a frangible and/or detachable fastener. An inflatable bladder is positionable within the canister and secures to a sealing member. The sealing member is slidably engaged with the canister and positionable proximate the first end to create a seal between the sealing member and canister. A pressurized air source is selectively placed in fluid communication with the second end of the pressurized air source to drive the sealing member toward the first and to inflate the bladder. As the sealing member is driven toward the first end, the bladder is forced out of the canister. A stop secured to the canister proximate the first end of the canister hinders the sealing member from leaving the canister. A fluid channel passes through the sealing member to enable gas or other buoyant fluids to pass through the sealing member into the bladder. A relief valve may be positioned within the channel and allow only fluid above a certain threshold pressure to pass through the channel.

In some embodiments, the bladder is encased in a frangible and/or detachable shell prior to deployment. After the bladder is forced out of the canister, expansion of the bladder causes the frangible and/or detachable shell to break apart and/or detach.

Other features, objects, advantages, and benefits of the invention will become apparent from the figures. It is also understood that the foregoing general description and the following detailed description are exemplary and explanatory but are not to be restrictive of the invention.

BRIEF DESCRIPTION OF THE DRAWINGS

The preferred and alternative embodiments of the present invention are described in detail below with reference to the following drawings. The accompanying drawings, which are incorporated in and constitute a part of this invention, illustrate some of the embodiments of the invention and, together with the description, seek to explain the principles of the invention in general terms. Like numerals generally refer to like parts throughout the disclosure.

FIGS. 8A-8G are a perspective and top views of a cylinder head and strap anchors, in accordance with an embodiment of the present invention;

DETAILED DESCRIPTION OF THE PREFERRED EMBODIMENT

Figure 1:
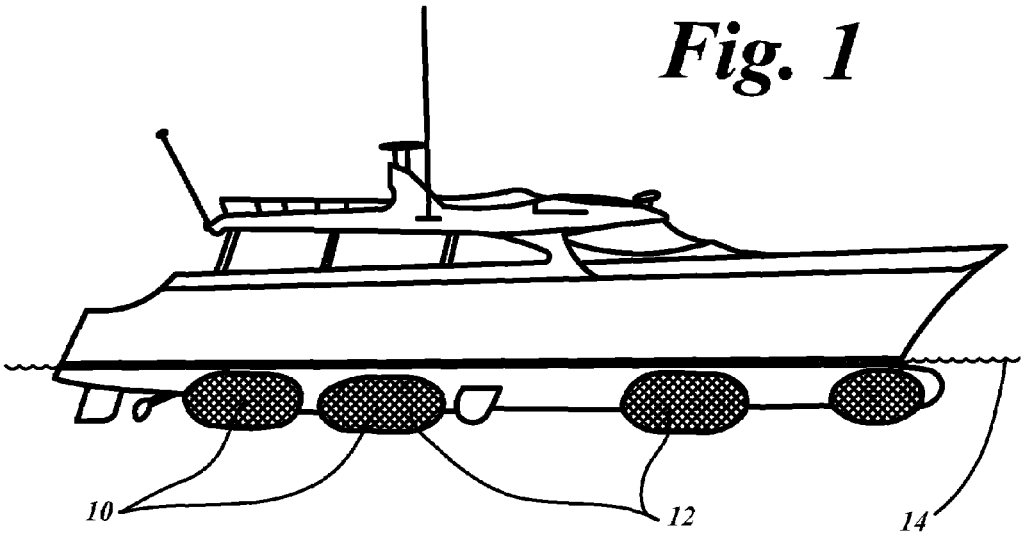
FIG. 1 illustrates a portside view of a luxury boat or yacht wherein buoyancy bladders are deployed along the vessel waterline 14, in accordance with an embodiment of the invention.
Figure 2A:
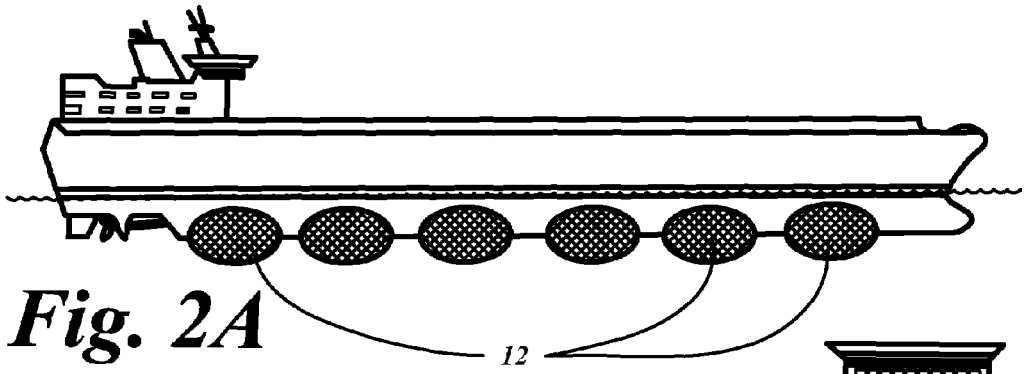
FIG. 2A shows a portside view of a cargo ship wherein buoyancy bladders are deployed along the vessel waterline, in accordance with an embodiment of the invention.
Figure 2B:
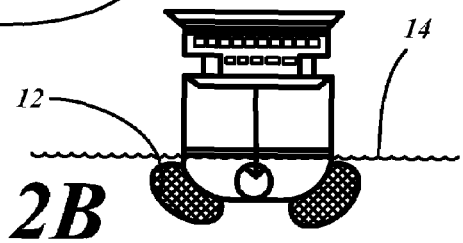
FIG. 2B shows a bow view of a cargo ship wherein buoyancy bladders are deployed along the vessel waterline, in accordance with an embodiment of the invention.

Referring to FIGS. 1 and 2, a compact encapsulated lift system 10 includes air bladders 12 deployed from air, water, and other, vessels of varying sizes and geometries. For example, as shown in FIG. 1, luxury boat or yacht may deploy four air bladders 12 per side. Typically at least two air bladders 12 per side are used to provide stability. However, even only one or two bladders total may be enough to provide significant benefits. As shown in FIG. 2A, a much larger cargo ship may deploy six or more air bladders 12 per side. The displacement of the air bladders 12 may also be increased based on the size of the vessels to which they mount. As shown in FIG. 2B, the air or foam bladders 12 mount to both sides of the vessel, such as the cargo ship. In the embodiment of FIGS. 2A and 2B, the bladders 12 protrude from the vessel at an angle such that an outer surface of the bladders 12 approximates the orientation of the hull. As is apparent form FIGS. 1 and 2A and 2B, the bladders 12 secure to the vessel below the waterline 14. Deployment below the waterline 14 is advantageous in that the amount of water displaced by the bladders 12 is larger.

Figure 3:
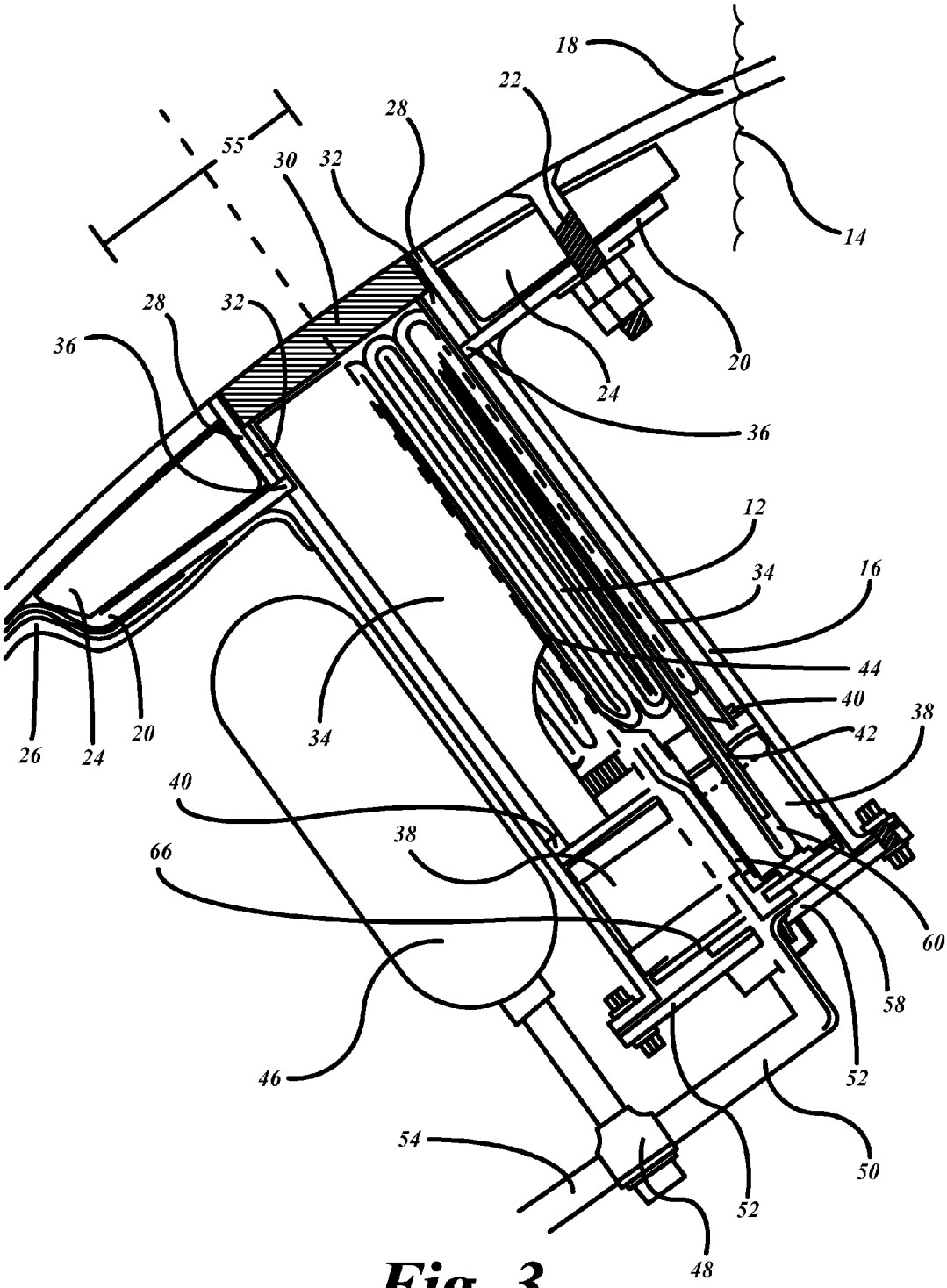
FIG. 3 is a side cross-sectional view illustrating the encapsulated lift system installed and in its retracted, stowed condition, in accordance with an embodiment of the invention.

FIG. 3 illustrates an embodiment of an encapsulated lift system 10 in a retracted and stowed condition. A housing canister 16 secures to a hull 18 of the vessel. The housing canister 16 may secure to a hull 18 at various angles including orthogonal to the hull of the vessel. In the illustrated embodiment, the canister 16 secures to a securing plate 20 by means of mechanical fasteners 22, such as bolts, screws, or the like. The mechanical fasteners 22 typically pass through a fairing block 24. The fairing block 24 is typically bonded to the hull 18 of the vessel as best suited to the vessel construction material. The housing canister 16 may also be laminated directly into a structure 26 forming part of the vessel.

A hull penetration cylinder 28 is bonded to the vessel's hull 18 and to a securing plate 20. An outer seal plug 30 is bonded within the inside wall of the hull penetration cylinder 28. The outer seal plug 30. is made of an impermeable marine grade material. The outer seal plug 30 forms a seal with the penetration cylinder 28 or canister 16. The seal plug 30 is adhered in a way that it will be easily removed from the hull 16 during deployment. In the illustrated embodiment, an outer seal stop 32 is formed on the canister 16 or penetration cylinder 28 and engages the seal plug 30. Sealing may be achieved by a sealant, such as a marine grade sealant, interposed between the seal plug 30 and the penetration cylinder 28 or canister 16. The outer seal plug 30, is secured to the inside wall of the hull penetration cylinder 28 and to the outer seal stop 32 in such a way that the force exerted by a bladder capsule 34 pressed against the outer seal plug 30 by means of pressurized air or other gas is sufficient to dislodge the outer seal plug 30 from the vessel. This may be accomplished by using a proper amount of sealant or glue to secure the plug 30 to the cylinder 28 or canister 16. Alternatively, frangible or detachable fasteners made of a breakable plastic, or the like, may be used. The outer surface of the seal plug 30 is typically flush with the outer plane of the vessel's hull 18 to reduce drag. The outer seal plug 30 is typically located below the water line 14 of the vessel.

While in the preferred embodiment the canister 16 is cylindrical, it could be square, triangular or of any shape in cross section. Similarly, while in the preferred system the outer seal plug 30 is released by means of the canister 16 being expelled, in alternate embodiments the seal plug 30 may be released by alternate means, alone or in combination with the pressure or impact of the canister. For example, a burst of air or other gas pressure directed at the seal plug 30 distinct from that used to inflate the bladder 12 may be employed. In an alternative embodiment, an explosive charge is used. In yet another alternative embodiment, an electronically activated switch may release or otherwise open the seal plug 30. Alternately, the seal plug 30 may be a hinged door, which is opened by means of any of the foregoing mechanisms, alone or in combination, or otherwise. Alternately, the seal plug 30 may include a scored or otherwise precisely "weakened" area of the hull that is strong enough for the vessel in ordinary use, but weak enough to neatly separate from the rest of the hull 18 when the system is deployed. Preferably, the geometry of the seal plug 30 is such that the water pressure from outside the vessel merely strengthens the seal (e.g. a frusto-conical shape).

The buoyancy bladder 12 is preferably made of a lightweight, gas impermeable material with specific attention to tensile strength, shear strength, and puncture resistance. The bladder 12 is compactly folded or otherwise arranged within the bladder capsule 34 so as to increase the amount of displacement while reducing the required size of the apparatus. The bladder capsule 34 has an outside dimension such that it will pass through the hull 18. In the illustrated embodiment, this includes passing through an aperture formed in the securing plate 20, the outer seal stop 32, a cylinder head stop 36, and through the hull penetration cylinder 28.

The cylinder head stop 36 engages a cylinder head 38 during deployment to prevent the cylinder head 38 from exiting the canister 16. Prior to deployment, the cylinder head 38 is located near the inboard end of the canister 16 as shown. A seal, such as a cylinder head O-ring 40 engages the cylinder head 38 and the canister 16 or cylinder head stop 36 to facilitate formation of a seal between the cylinder head 38 and the canister 16 or cylinder head stop 36. Securing straps or cables 42 for restraining the bladder 12 are folded parallel to the bladder 12 prior to deployment. The straps or cables 42 attach to the cylinder head 38.

The buoyancy bladder 12 is filled by means of a flexible hose 44 attached to the buoyancy bladder 12. A pressurized gas source 46 is connected to the flexible hose 44. In the illustrated embodiment, a deployment valve mechanism 48 and tubing 50 connect the gas source 46 to the flexible hose 44. The tubing 50 may also be flexible. The flexible tubing 50 directs pressurized gas or foam through a housing canister end plate 52 and into the cylindrical housing canister 16. The valve mechanism 48 can be operated by a mechanical, electrical, manual, or other appropriate device which may detect the presence of a sinking risk and trigger deployment accordingly. Alternatively, the valve mechanism 48 may be coupled to an alarm or other system automatically or manually triggered when a sinking risk arises. The valve mechanism may also be manually activated by means of an electrical or mechanical switch. Manual activation may be as an override of an automatic triggering mechanism or the exclusive means for activating the system. While the pressurized gas source 46 may be centrally located and connected by a flexible hose 54 to multiple encapsulated lift system 10, individual encapsulated lift systems 10 may also be fitted with a self-contained gas source 46. In the operation of the system, when the boat encounters a serious condition, the deployment valve mechanism 48 can be operated either manually or automatically to initiate the deployment of the buoyancy bladder 12.

Figure 4:
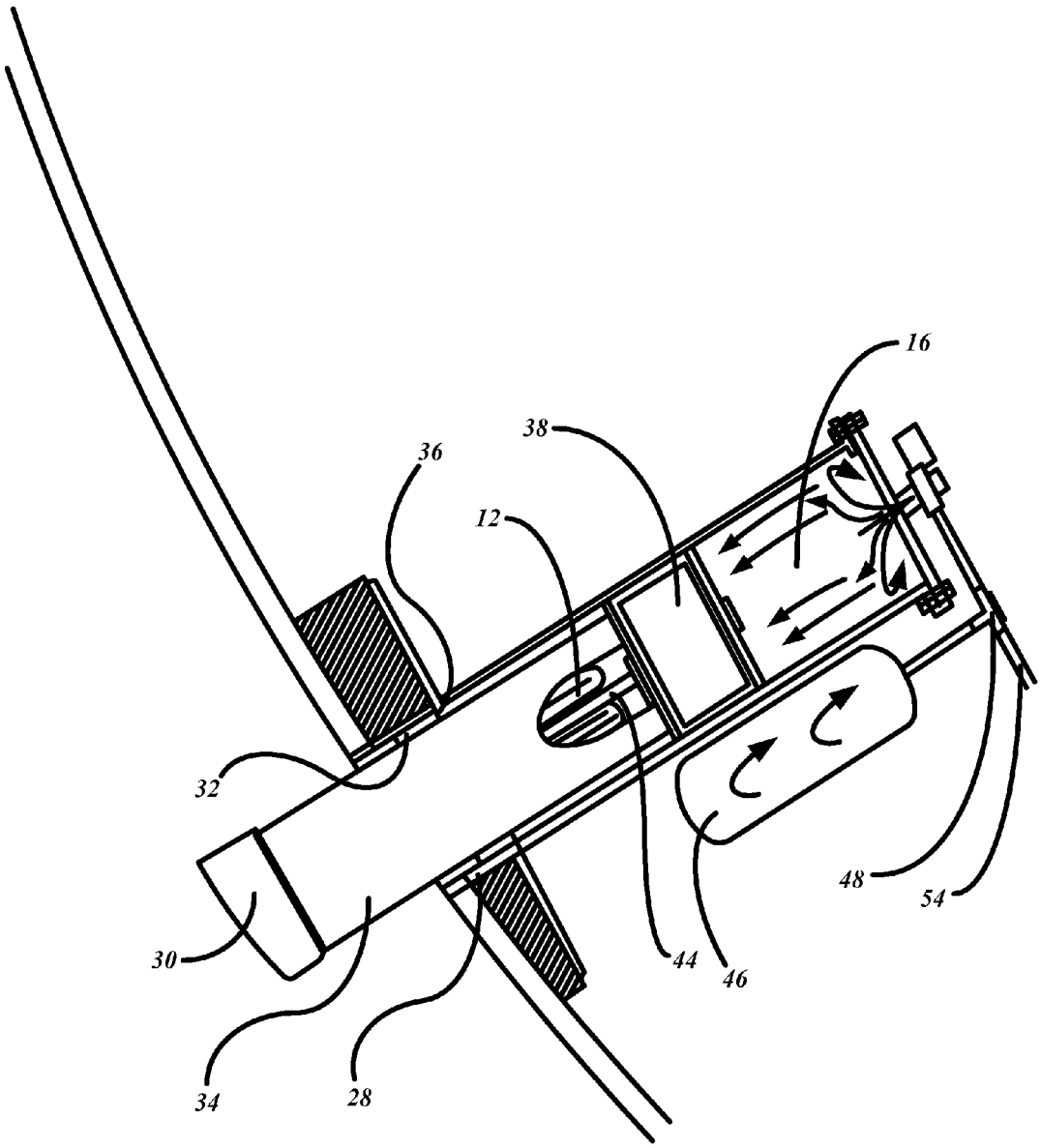
FIG. 4 is a side cross-sectional view of the encapsulated lift system after initial activation, in accordance with an embodiment of the invention.

FIG. 4 illustrates the outer seal plug 30 dislodged from the hull penetration cylinder 28, by the bladder capsule 34. Once pressurized gas or foam is introduced into the cylindrical housing canister 16 by either a central, or self-contained source 46 (or a combination of both) through the deployment valve mechanism 48, the outer seal plug 30 is dislodged by the outboard end of the bladder capsule 34, allowing the bladder 12 positioned within the bladder capsule 34, to exit in an outboard direction from the vessel.

Figure 5:
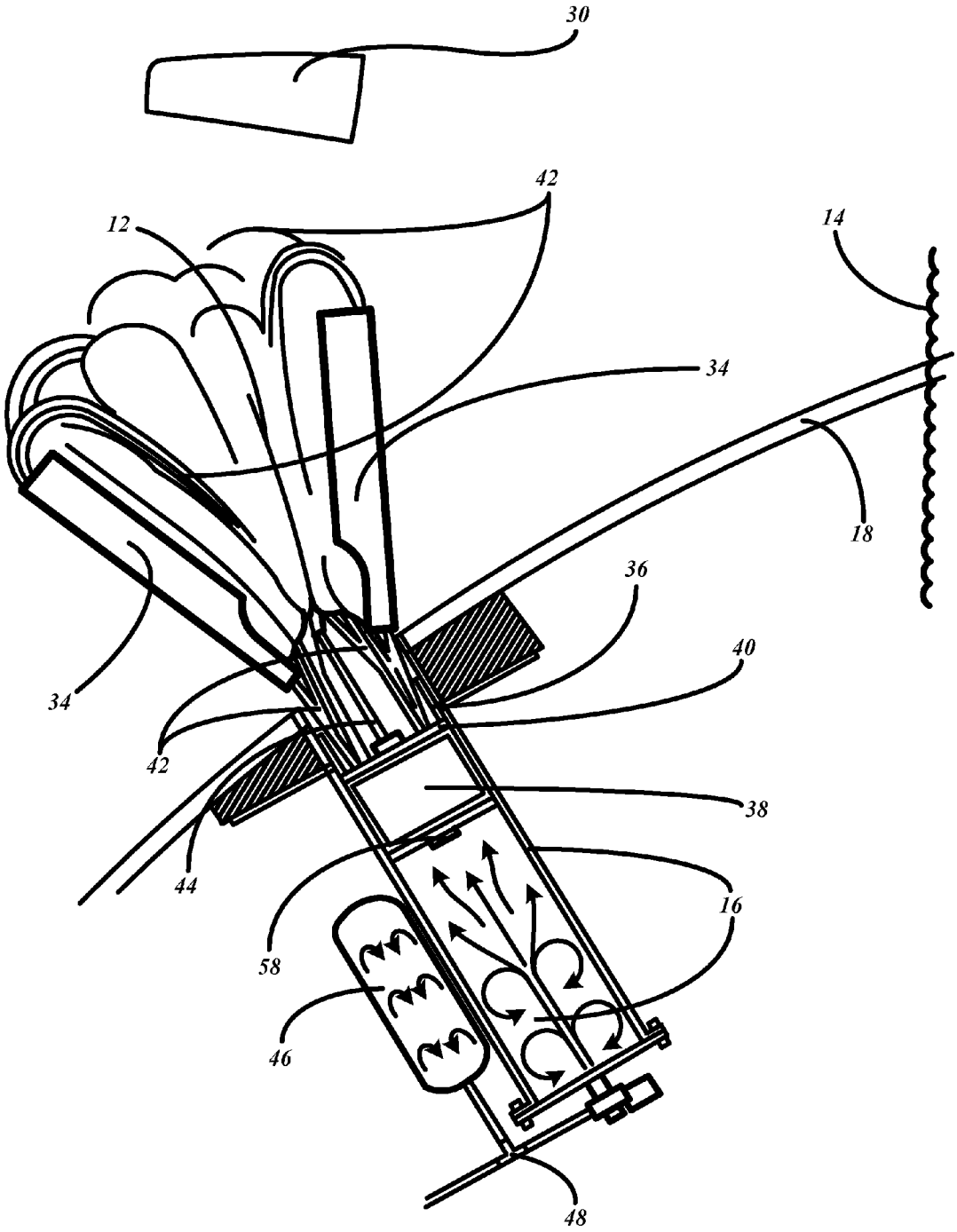
FIG. 5 is a side cross-sectional view of the encapsulated lift system in mid deployment, in accordance with an embodiment of the invention.

FIG. 5 illustrates the bladder capsule 34 housing the buoyancy bladder 12 breaking apart as the bladder 12 is inflated. The capsule 34 is typically made of a thin material grooved, scored, perforated, or otherwise configured, to promote separation after the capsule 34 has been expelled from the vessel and pushed free of the vessel by a cylinder head 38. The capsule 34 may also be made of multiple pieces secured to one another to promote separation or selectively weakened to promote breakage.

The cylinder head 38 secures to the straps 42 securing the air bladder 12. The cylinder head 38 likewise includes an aperture permitting pressurized gas to pass from within the cylindrical housing canister 16 into the flexible tube 44. The cylinder head 38 is sized to engage the hull 18 or a structure secured to the hull 18 in order to form a seal. In the illustrated embodiment, the cylinder head 38 engages a cylinder head O-ring 40 to form a seal. A cylinder head stop 36 engages the cylinder head 38 to hinder the cylinder head 36 from leaving the canister 16 and to create a seal between the canister and the cylinder head 38.

Figure 6:
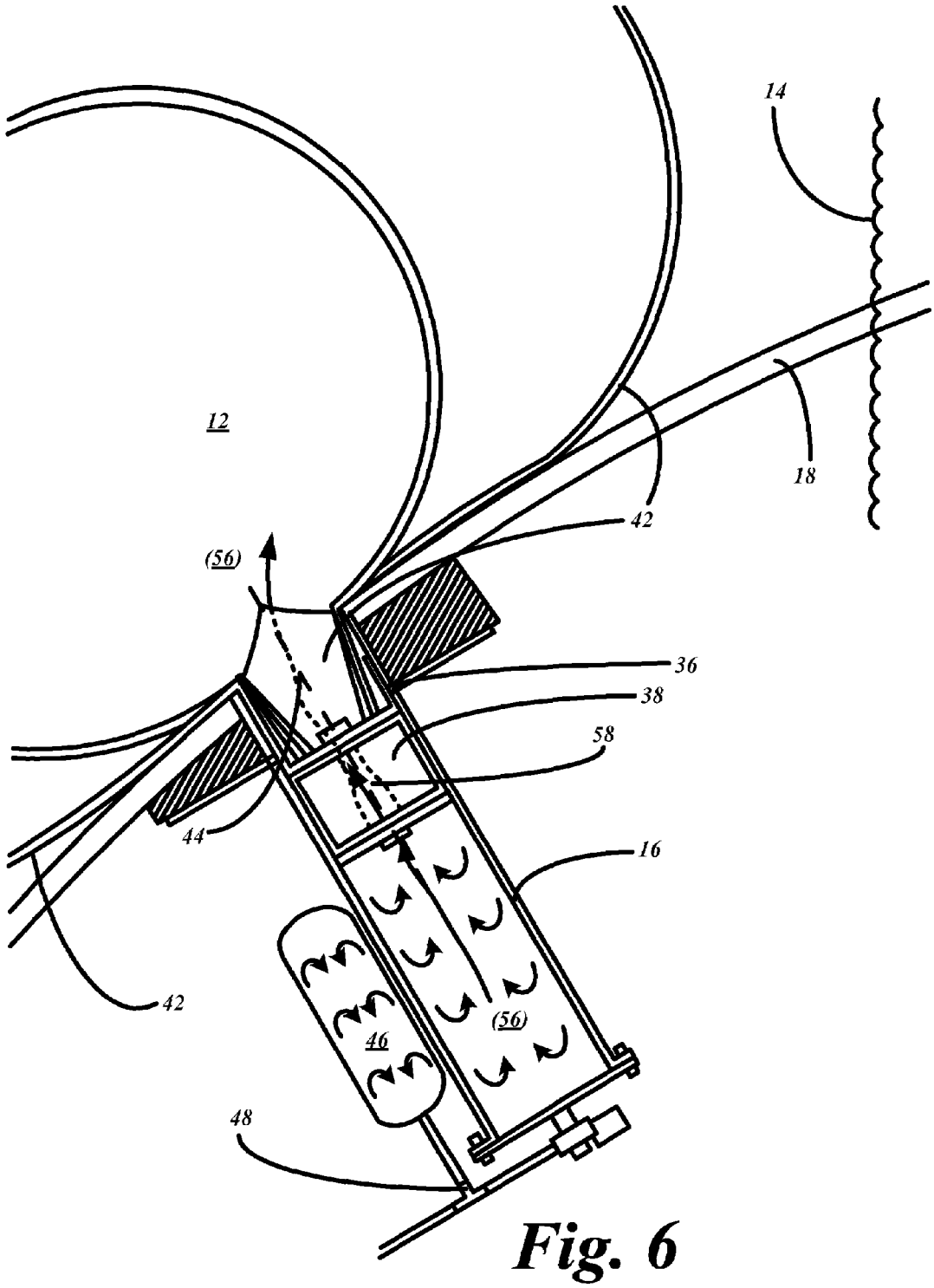
FIG. 6 is a cross-sectional view of the encapsulated lift system deployed in full displacement, in accordance with an embodiment of the invention.

Referring to FIG. 6, as the pressure of the gas 56 within the canister 16 increases, a pressure-regulated relief valve 58 within the cylinder head 38 opens and allows pressurized gas or foam into the bladder 12 by means of the flexible bladder hose 44. As the bladder 12 fills with gas, the vessel is lifted and cradled. Within minutes after deployment the needed buoyancy and stability is provided, as illustrated in FIGS. 1 and 2.

The novel apparatus disclosed is sufficient to anchor the buoyancy bladder 12 within the encapsulated lift system 10 and thus to the vessel (See FIGS. 1, 2, and 6). The straps or cables 42 may have a length chosen to hold the bladder 12 in a way that cradles the vessel adding to its buoyancy and stability, as shown in FIGS. 1 and 2.

Figure 7:
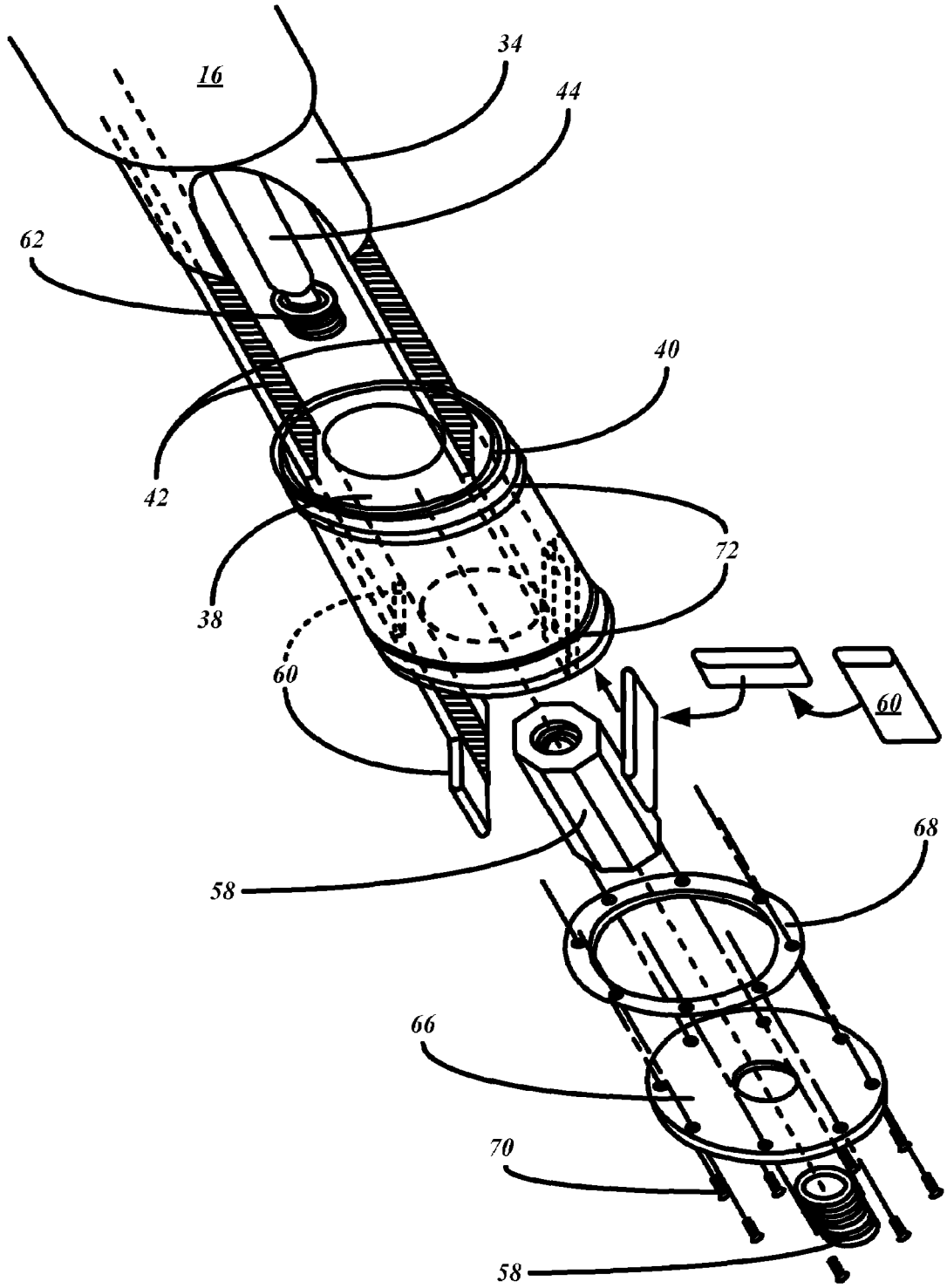
FIG. 7 is an exploded perspective view of the internal workings of the canister, in accordance with an embodiment of the invention.

FIG. 7 is an exploded isometric view of the encapsulated lift system 10. The bladder capsule 34 is shown extended from the cylindrical housing canister 16. The bladder securing straps 42 are also visible as they enter the cylinder head 38. The straps 42 are secured by bladder strap anchors 60 to the cylinder head 38. The bladder fill hose 44 is attached to the pressure regulating relief valve 58 by a fitting tube connector 62. The pressure regulating relief valve 58 is secured within the cylinder head 38 by a pressure relief valve end cap 64, attached to the pressure regulating relief valve 58 through a cylinder head end plate 66. A cylinder plate gasket 68 is fitted between the cylinder head 38, and the cylinder end plate 66. Multiple fasteners 70 pass through the cylinder head end plate 66 and the cylinder plate gasket 68 where they secure the pressure-regulating relief valve 58 within the cylinder head 38.

The bladder securing straps 42 extend through the bladder capsule 34 and secure to the cylinder head 38. In the illustrated embodiment, the straps 42 secure to the cylinder head 38 by attaching to bladder strap anchors 60 positioned within the cylinder head 38. The strap anchors 60 are sized such that they cannot be pulled through apertures within the cylinder head 38 through which the straps 42 are passed. The straps 42 may secure to the strap anchors 60 by various means, such as being looped through a slot formed therein or looped around a rod or like structure affixed within the strap anchor 60. The straps 42 may also be bonded to the structure of the bladder 12. Because larger buoyancy bladders may require additional straps, multiple anchors 60 can be fitted within the cylinder head 38 in some applications. The cylinder head 38 may include multiple cylinder head guide rings 72 with an outside diameter such that they direct and maintain travel down the interior wall of the cylindrical housing canister 16. The cylinder head guide rings 72, the cylinder head O-ring 40, and the cylinder plate gasket 68 share in providing an airtight seal between the cylinder head 38 and the canister 16 to facilitate the expelling of the bladder capsule 34, and the buoyancy bladder 12, from inside the cylindrical housing canister 16.

FIGS. 8A-G illustrate various isometric and other views of the cylinder head and strap anchors. FIGS. 8A-C shows multiple views of the cylinder head 38, with special attention to the cylinder guide rings 72. FIG. 8D is an expanded view showing the cylinder head end plate 66, the cylinder plate gasket 68, the cylinder guide rings 72, the cylinder head O-ring 40, and the multiple fasteners 70 used to secure the end plate 66 to the cylinder head 38. FIGS. 8E-G show additional views of the cylinder head with special attention to the bladder straps 42 and show the strap anchors 60 as they secure the bladder straps 42 to the cylinder head 38. The bladder strap anchors 60 are fitted within the cylinder head 38 in such a way that the outward pull on the straps will not allow the stops or straps to move from their location within the cylinder head 38.

Figure 9:
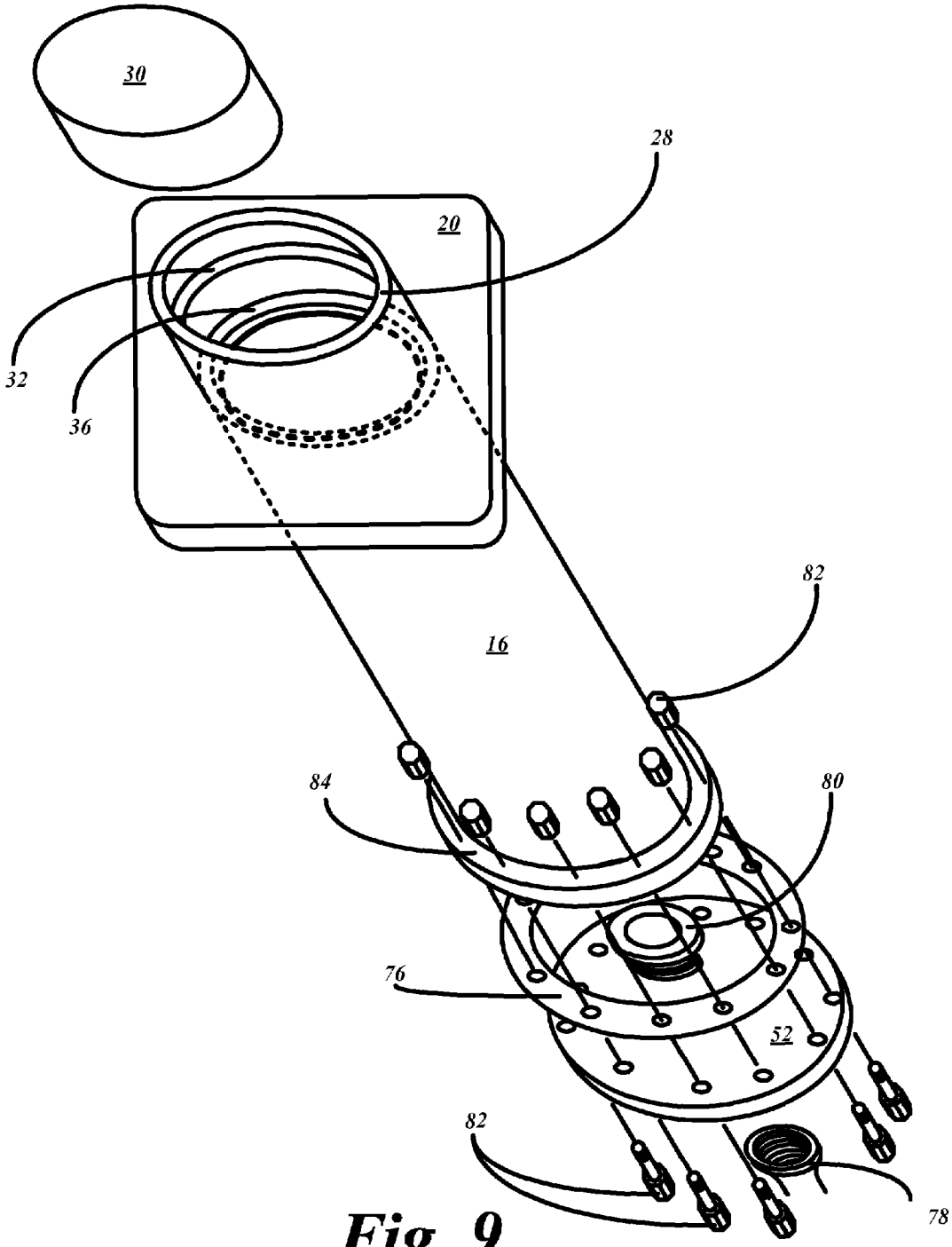
FIG. 9 is an exploded isometric view of the housing canister and securing plate, in accordance with an embodiment of the invention.

FIG. 9 is an exploded isometric view of the housing canister 16. A canister end plate 52 secures to the inboard end of the housing canister 16. The end plate 52 may be removed from inside the vessel in order to service and test the encapsulated lift system 10. Inasmuch as the encapsulated lift system 10 may be positioned below the water line 14, it may be advantageous to service the system 10 from inside a vessel in order to service the system 10 notwithstanding external obstructions such as water, shoring, blocking, scaffolding, or other exterior structures. The encapsulated lift system 10 may be serviced by other means, for example, the canister 16 may be removed from the securing plate 20. Alternatively, the securing plate 20 may be removed from the fairing block 24. In yet another alternative embodiment, the canister 16 comprises a removable side section to enable servicing. An end plate gasket 76 may be interposed between the canister end plate 52 and the housing canister 16. A compressed gas fill tube 78 secures to the canister end plate 52. A fitting 80 positioned on the outboard side of the canister end plate 52 may extend through the canister end plate 52 and connect to the gas fill tube 78 by means of threads, or a like fastening means. Multiple end plate fasteners 82 may pass through the canister end plate 64 and end plate gasket 76 and secure to a canister flange ring 84 secured to the cylindrical housing canister 14.

The hull penetration cylinder 28 extends outboard from the securing plate 20. The hull penetration cylinder 28 may also secure directly to the housing canister 16 or be formed monolithically with the housing canister 16. The outer seal stop 32 secured within the hull penetration cylinder 28 provides a seating surface for the outer seal plug 30 within the housing canister 16 or hull penetration cylinder 28. The cylinder head stop 36 may be positioned and bonded against the canister securing plate 20 to maintain the cylinder head 38 and therefore the bladder straps 42, connected to the vessel.

Figure 10:
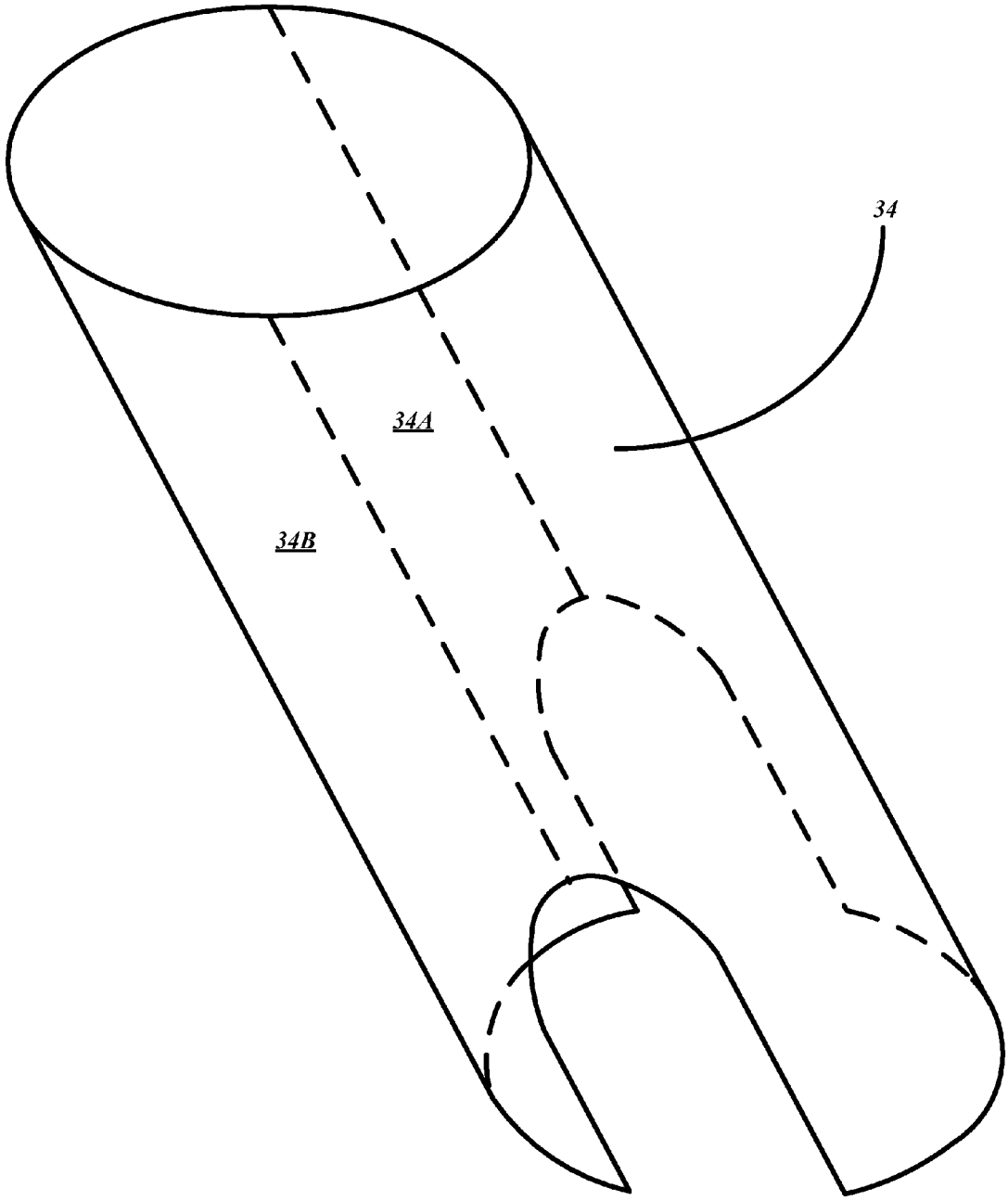
FIG. 10 is an isometric view of the bladder capsule, in accordance with an embodiment of the invention.

FIG. 10 is an isometric detail view of the bladder capsule 34 having two sections 34A, 34B having a thin, rigid construction with side scoring therebetween for ease of separation once outside of the vessel. The bladder capsule 34 may be constructed in a variety of means. For example, the walls may be thin enough to be ruptured when pressurized gas is introduced into the air bladder 12 positioned therein. Alternatively, the capsule 34 may be formed of multiple pieces 34A, 34B connected by a frangible material. In the illustrated embodiment, the capsule 34 includes a cutout at one end to facilitate breaking of the capsule 34.

Figure 11B:
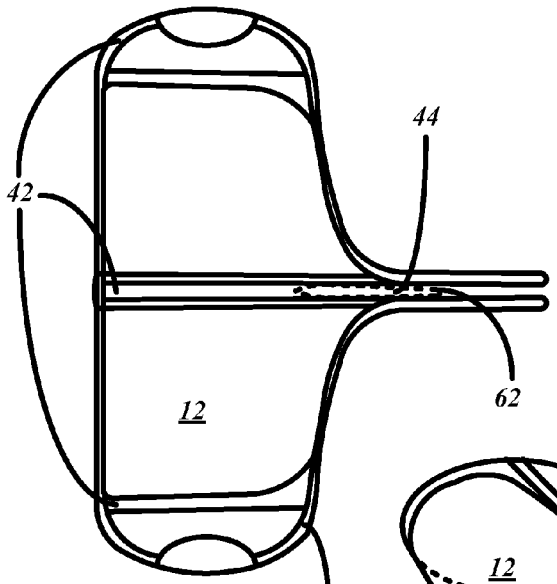
FIGS. 11A-11C illustrates side, top and isometric views, respectively of the deployed buoyancy bladder, in accordance with an embodiment of the invention.
Figure 11C:
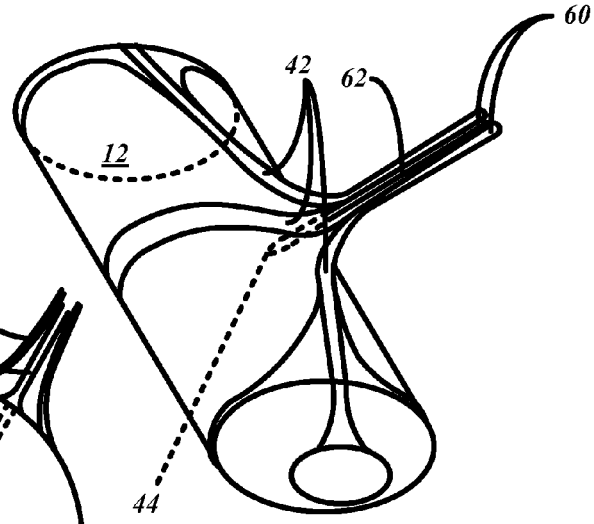
Figure 11A:
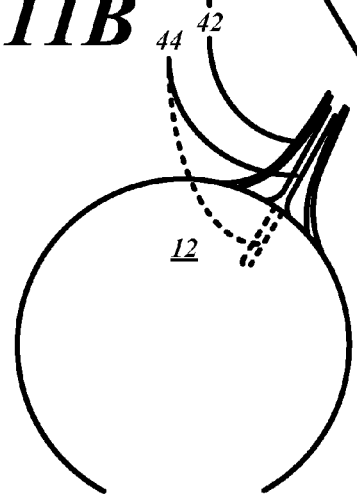

FIGS. 11A-C show side, top, and isometric views of the bladder 12 with special attention to the bladder straps 42, the fill hose 44, and the strap anchors 60. As is apparent, the straps 42 encircle the bladder 12 at various points and are also connected to the ends of the bladder 12. The bladder 12 typically has a size and shape chosen to have a large amount of below-water displacement. In the illustrated embodiment, the bladder 12 has an elongate shape, such as a substantially cylindrical shape.

Figure 12:
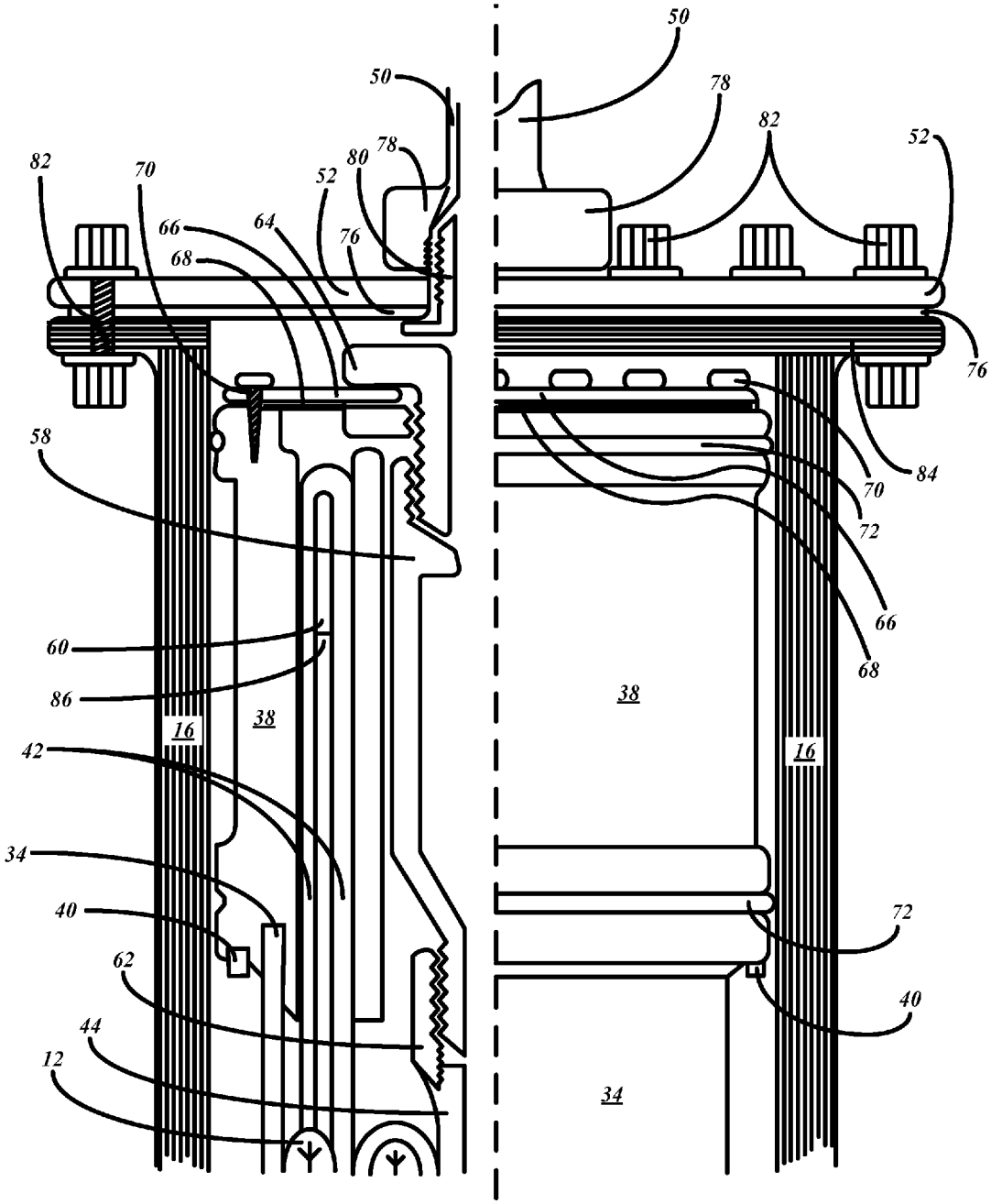
FIG. 12 illustrates a side view in greater detail of the internal workings of the cylinder head within the canister.

FIG. 12 is a partial cut-a-way view showing the cylinder head 38 and canister 16 in greater detail. The fill tubing 78 is attached to a fitting 80 positioned on the outboard side of the housing canister end plate 52 and the housing canister end plate gasket 76. The canister end plate 52 is secured to the cylindrical housing canister 16 by multiple fasteners 82 extending through the housing canister flange ring 84. The cylinder head 38 is shown in a non-deployed storage location at the inboard end of the encapsulated lift unit 10. The pressure regulating relief valve 58 is attached at the outboard end of the cylinder head 38 and at the cylinder head end plate 66. The pressure regulating relief valve 58 is secured to the cylinder head 38 by multiple fasteners 70 passing through the cylinder plate 52 and gasket 68. The bladder straps 42 are secured by the bladder strap anchors 60. The bladder straps 42 pass through slots 86 formed in the cylinder head 36 in such a way that the outward pull on the straps will press the anchors 60 against the walls of the slots 86. The slots 86 are sized such that the anchors 60 cannot pass therethrough. The bladder straps 42 run parallel to the bladder hose 44 and the fitting tube connector 62 toward the buoyancy bladder 12. The bladder capsule 34 is shown fitted within a machined groove receiving a portion of the cylinder head O-ring 40 when the bladder capsule 34 is within the canister 16.

Various alternative embodiments of the invention described are possible. For example, two air bladders 12 and associated cylinder heads 38 and other structures may mount within a single canister 16 in an opposed configuration such that the air bladders 12 are deployed out of opposite ends of the canister 16. In this manner, a single pressurized gas source 46 and deployment valve mechanism 48 is needed to deploy both air bladders 12.

While preferred embodiments of the invention have been disclosed in detail, it should be understood by those skilled in the art that other modifications may be made to the illustrated embodiments without departing from the scope of the invention as described in the specification and defined in the appended claims. For example, the above described device may be used on a wide range of vehicles relying at times on buoyancy in water or other fluids. For example, manned and remote control research or observation vessels used both below and above water, floating oil derricks, barges, submarines, buoys, buoy retrievers, air or space craft, and the like.

The embodiments of the invention in which an exclusive property or privilege is claimed are defined as follows:

1. A buoyancy device for a vessel, the device comprising:

a canister secured to the vessel;

a cylinder head movable relative to the canister, the cylinder head having a first surface operated on by a fluid within the canister;

an inflatable bladder coupled to the cylinder head and movable therewith, the bladder in fluid communication with the fluid in the canister; and a bladder capsule movable by the cylinder head, the bladder capsule sized to house the inflatable bladder while the inflatable bladder remains in a non-inflated configuration, the bladder capsule configured to break apart during inflation of the bladder.

2. The buoyancy device of claim 1, further comprising a stop member coupled to the canister, the stop member arranged to prevent movement of the cylinder head out of an aperture in the vessel.

3. The buoyancy device of claim 1, further comprising a plug sized to substantially fill an aperture in the vessel, the plug detachably coupled to the vessel

4. The buoyancy device of claim 1, wherein the plug being detachably coupled to the vessel includes the plug being bonded to the canister.

5. The buoyancy device of claim 1, further comprising a relief valve in fluid communication with the fluid in the canister, the relief valve configured to provide fluid to the inflatable bladder when a pressure in the canister reaches a threshold pressure.

6. The buoyancy device of claim 1, wherein the bladder capsule is sized to fit within the canister.

7. The buoyancy device of claim 1, wherein the canister is secured to the vessel below a waterline of the vessel.

* * * * *

UNITED STATES PATENT AND TRADEMARK OFFICE

CERTIFICATE OF CORRECTION

PATENT NO. : 7,644,673 B2
APPLICATION NO. : 11/379989
DATED : January 12, 2010
INVENTOR(S) : Darrin John Schmitt It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 178 days.

Signed and Sealed this

Twenty-first Day of December, 2010

David J. Kappos

David J. Kappos
*Director of the United States Patent and Trademark Office*